United States Patent [19]

Happach

[11] Patent Number: 4,491,812

[45] Date of Patent: Jan. 1, 1985

[54] OVERLOAD PROTECTION

[75] Inventor: Anton Happach, Munich, Fed. Rep. of Germany

[73] Assignee: Schaltbau Gesellschaft mbH, Munich, Fed. Rep. of Germany

[21] Appl. No.: 573,069

[22] Filed: Jan. 23, 1984

[30] Foreign Application Priority Data

Jan. 24, 1983 [DE] Fed. Rep. of Germany ..... 3302229

[51] Int. Cl.[3] ..... H01H 9/00

[52] U.S. Cl. ..... 335/184; 335/267; 335/268

[58] Field of Search ..... 335/126, 131, 177, 184, 335/255, 266, 267, 268

[56] References Cited

U.S. PATENT DOCUMENTS 1,297,979 3/1919 Valkenburg ..... 335/184 X 2,901,210 8/1959 Hebard ..... 335/267 X

FOREIGN PATENT DOCUMENTS 1432372 4/1976 United Kingdom ..... 335/184

*Primary Examiner*—George Harris

*Attorney, Agent, or Firm*—Ralf H. Siegemund

[57] ABSTRACT

A particular overload protection is provided for a circuit which is normally closed by an electromagnetic circuit breaker energized by a relatively low level holding current. The overload protection is particularly provided through an auxiliary electromagnetic system connected to be responsive to the current in the circuit governed by the circuit breaker whereby the auxiliary electromagnetic system includes an armature carrying a plunger penetrating the circuit breaker such that upon occurence of an overload the auxiliary electromagnetic system is energized and its plunger pushes the armature of the circuit breaker into a contact opening disposition.

4 Claims, 2 Drawing Figures

OVERLOAD PROTECTION

BACKGROUND OF THE INVENTION

The present invention relates to the protection of an electrical circuit against overload and here particularly against excess currents.

Overload protection for an electrical circuit may be provided directly through a circuit breaker which includes an armature for operating one or several pairs of contacts, particularly indirectly through release of another spring while acting against a return spring, the latter being stronger than the former but the former provides the requisite contact pressure. Moreover, the circuit breaker includes a magnetic core having an axial bore which traverses and penetrates the core entirely which bore is, therefore, accessible from the side facing away from the armature. The circuit breaker of the type mentioned thus far is, for example, described in German printed patent application No. 24 18 930.

Usually, circuit breakers are operated in such a manner that the current in the energizing coil increases until attracting the armature so that the armature in turn can cause the contacts to be closed. Following the electromagnetic attraction, the holding current through the energizing coil is reduced particularly for purposes of saving current, which is highly desirable, for example, in case a circuit pertains to a railless vehicle receiving power from electric batteries. Therefore, these kind of circuit breakers function essentially as electromagnetically operated devices. Therefore, they require supplemental elements in order to provide full protection of the normally goverened by the circuit breaker circuit. Consequently, the space requirement is fairly large, which again is undesirable in case of mobile equipment such as battery powered vehicles or the like.

DESCRIPTION OF THE INVENTION

It is an object of the present invention to provide a new and improved protective device in electric circuits, governed by circuit breakers for protecting the circuit proper against overload currents and having the same degree of operative certainty and safety of operation as the prior art devices but being provided in a more compact design.

It is a particular object of the present invention to provide overload protection in an electric circuit being governed by an electromagnetically operated circuit breaker with spring bias and multiple contact operation.

In accordance with the preferred embodiment of the present invention, it is suggested to provide a supplemental or auxiliary electromagnetic system being coaxial to a bore in the core of the circuit breaker as per this particular object which supplemental electromagnet systeme has a coil being passed through by electric current whenever the circuit breaker has responded; the armature of this supplemental electromagnet is to move opposite the direction of movement of the armature of the circuit breaker and the core of the auxiliary electromagnet is to be provided with a bore which is aligned with the bore of the core of the circuit breaker; the air gap of the auxiliary electromagnet is to be sufficiently large so that current flowing through under normal operations (no overload) will not cause the armature to be attracted. Only overload current in the principal circuit will provide such attraction; moreover, the two bores are penetrated by a common plunger or rod which is affixed to the armature of the supplemental or auxiliary electromagnet. The plunger or rod is dimensioned so that in case of no energization of the supplemental electromagnet under conditions of energization of the circuit breaker, the rod or plunger is spaced from the armature of the circuit breaker at a distance smaller than the lifting stroke of the armature of auxiliary and supplemental electromagnet.

DESCRIPTION OF THE DRAWINGS

While the specification concludes with claims particularly pointing out and distinctly claiming the subject matter which is regarded as the invention, it is believed that the invention, the objects and features of the invention and futher objects, features and advantages thereof will be better understood from the following description taken in connection with the accompanying drawings in which:

Proceeding now to the detailed description of the drawing, FIG. 1 illustrates a regular circuit breaker with plunger type armature and denoted generally as a group of elements 1. Basically, the circuit breaker includes a coil 2 on a coil carrier 2*a* surrounding a magnetic core 3 holding through the dotted yoke 4 the pole ring 5. The other end of the core 3 carries directly a pole ring 6. The circuit breaker 1 is shown in operating position, i.e. after response to a normal operating command. This means in particular that the coil 2 is flown through by a holding current so that an armature 7 of the circuit breaker has been attracted into the gap space delineated by pole ring 5 as well as by the axial end 3*a* of core 3. In fact, then, the armature 7 is retracted generally into the coil core system against the force of a spring 8. Armature 7 carries coaxially an operating plunger 12.

Figure 1:
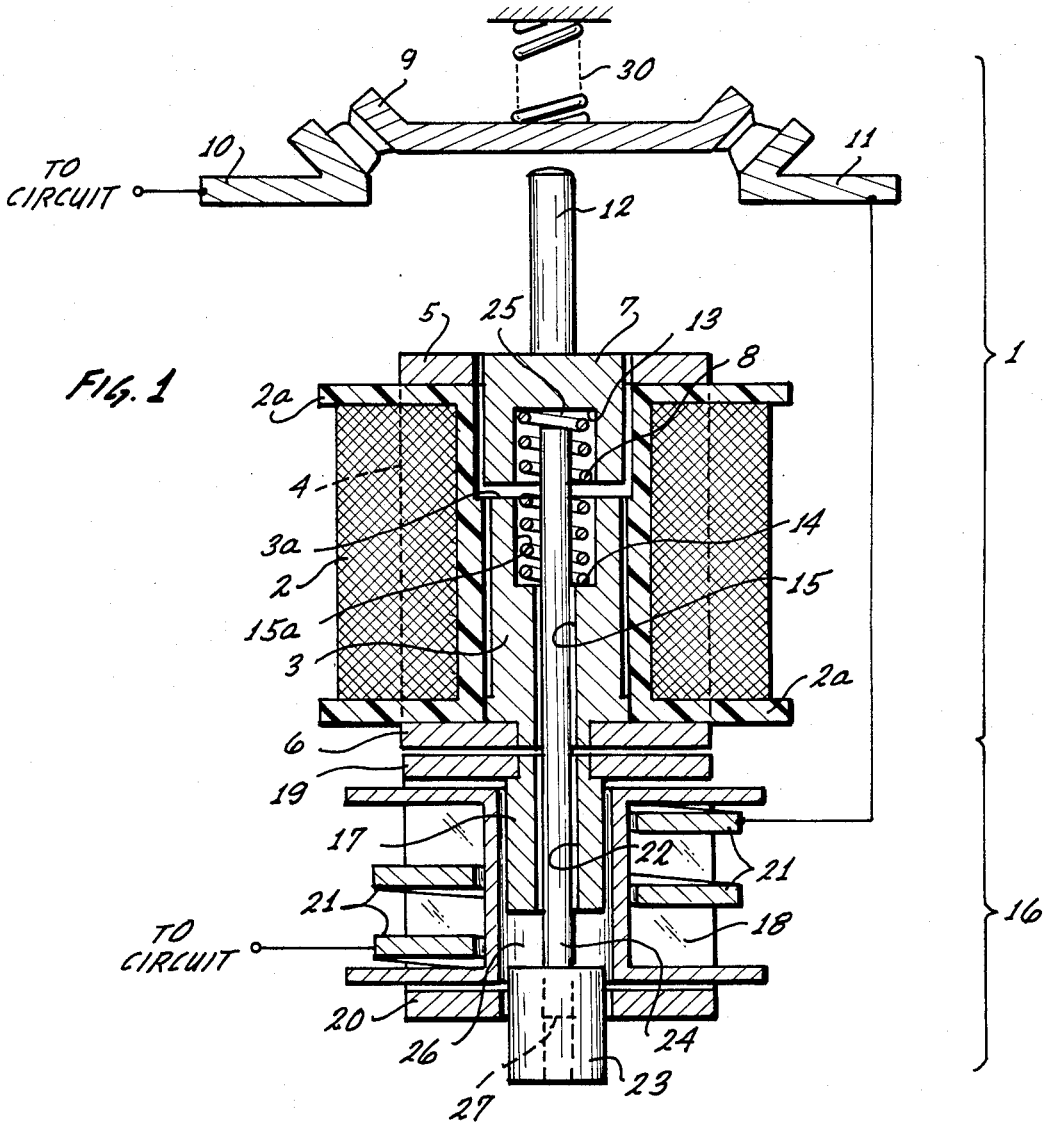
FIG. 1 is a somewhat schematic section view through a circuit breaker with supplemental electromagnet as per the preferred embodiment of the present invention for practicing the best mode thereof.

In the disposition as illustrated plunger 12, armature 7 though retracted releases a spring 30 which is generally weaker than the restricting spring 8 but establishes the contact pressure by means of which a contact bridge 9 rests on stationary contacts 10 and 11. Plunger 12 is disengaged from bridge 9.

The return spring 8 is partially inserted in a blind bore 13 of the armature 7. The other end of return spring 8 bears against a shoulder 14 which establishes a widening within the core from a relatively small diameter bore 15 to a larger diameter bore 15*a* which is in alignment with the blind bore 13. The central bore 15 penetrates the core 3 in its entirety and establishes so to speak the basic axis of the system, details thereof will be described below.

Having thus far described the basic circuit breaker configuration, reference is made now to a supplemental and auxiliary electromagnet or, better, electromagnet system generally designated by reference numeral 16. This electromagnet system includes a magnet core 17 with a yoke 18 and pole rings 19 and 20. The electromagnet system furthermore includes a coil 21 which is comprised of relatively few windings. This coil 21 is electrically connected to the contact system 9, 10 and 11 of the circuit breaker 1. In other words coil 21 receives a small bypass current from the load current through the circuit and the contacts 9, 10, and 11.

The core 17 of the auxiliary electromagnet system 16 includes likewise a bore 22 which traverses the core 17 in its entirety. Moreover, the elements are mounted in relation to each other such that the bore 22 is axially aligned with the bore 15 of the magnet core 3 of circuit breaker 1.

The auxiliary magnet system 16 furthermore includes a plunger type armature 23 which assumes the position as illustrated in FIG. 1 whenever the magnet system 16 is not energized. This armature 23 is now affixed to a plunger or rod 24 penetrating the bores 22 and 15 as well as the spring 8. The plunger or rod 24 has a particular length which is defined as follows. As stated, the auxiliary electromagnetic system 16 is in the unenergized state as per FIG. 1 while the circuit breaker 1 is energized. This then establishes a particular disposition of the plunger or rod 24 in relation to the armature 7 of the energized circuit breaker (as in gap 26). This disposition in turn establishes a distance 25 between the plunger or rod 24 and the armature 7. This particular distance 25 is smaller than the lifting stroke 26 imparted by the magnet system 16 upon its armature 23. The rod 24, of course, is affixed to the armature 23 so that the distance and space relations are directly related and relatable to each other.

As the current through the contact system 9, 10 and 11 increases the current through the coil 21 of the magnet system 16 increases likewise. If the permissable magnitude of that current is exceeded the coil 21 will energize the system 16 such that the armature 23 is attracted to the core 17. Since, as stated, the lifting stroke 26 of the armature 23 as so attracted is larger than the distance 25 of the plunger 24 from the armature 7, and since the relationships of movement are in opposition to each other and since the armature 7 is held by the spring 8, the following transpires.

The plunger 24 will necessarily impact upon the armature 7 and will drive the armature 7 from its illustrated disposition. This means that the actuating plunger 12 pushes against the contact bridge 9 and opens the circuit connection between the contact 10 and 11. One can see that for reasons of proper mechanical force transmission, plunger 24 should be coaxial with plunger 12.

In order to adjust the sensitivity of the auxiliary magnet system 16, it is suggested to vary the length insertion of the plunger 24 into the armature 23, for example, by means of a screw connection 27 or otherwise. This, in effect, adjusts the distance 25 which the tip of the plunger 24 has to traverse before impacting upon the armature 7.

Figure 2:
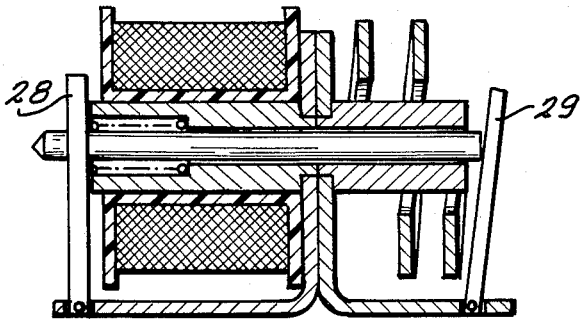
FIG. 2 is a somewhat schematic modification of the structure shown in FIG. 1 still constituting a preferred embodiment of the invention.

The inventive concept is applicable also to a pivot armature type of circuit breaker. The various elements shown in FIG. 2 are quite similar to those shown in FIG. 1 which includes particularly the construction of the circuit breaker. The difference, however, resides in the employment of pivot armatures 28 and 29 for the circuit breaker 1 and the auxiliary system 16 respectively. In other words, the difference can be seen in that rather than providing mere lifting of the contact bridge 9, pivot motion is introduced but involves still axial plunger movement as described.

The invention is not limited to the embodiments described above but all changes and modifications thereof not constituting departures from the spirit and scope of the invention are intended to be included.

I claim:

1. Overload protection for an electric circuit which includes contacts operated by a spring biased electromagnetic circuit breaker including an electromagnetic energizing system and an armature which is retracted against the force of the spring for contact closing and wherein said contacts are closed for unenergized circuit breaker by means of a second spring being weaker than the first one, said electromagnetic circuit breaker including a core system having a bore, the overload protection comprising:

an auxiliary electromagnet system having a core, the core being provided with a bore, the core being arranged and situated so that its bore is aligned with the bore of the core system of the circuit breaker;

the auxiliary electromagnetic system having a coil being electrically connected to said circuit to be flown through by a bypass current whereby regular current flowing through the contacts of the circuit breaker is correspondingly insufficient to energize the auxiliary electromagnetic system;

said auxiliary electromagnetic system having an armature being in a particular position as long as the auxiliary electromagnetic system is not energized;

a plunger mounted to the armature of the auxiliary electromagnetic system and penetrating both of said bores whereby for unenergized auxiliary electromagnetic systems a distance of said plunger from the armature of the circuit breaker is smaller than a lifting stroke of the armature of the auxiliary electromagnetic system; and so that upon energization of the auxiliary electromagnetic system on account of an overload in said circuit, the armature of the auxiliary electromagnetic system is attracted to the core of the auxiliary electromagnetic system and the plunger pushes the armature of the circuit breaker into a position such that said circuit breaker contacts in said circuit are opened.

2. Overload protection as in claim 1 wherein a connection of the plunger to the armature of the auxiliary electromagnetic system is adjustable such that said distance is adjustable accordingly.

3. Overload protection as in claim 1 wherein said armatures are of the plunger type.

4. Overload protection as in claim 1 wherein said armatures are of the pivot type.

* * * * *